US006286582B1

(12) United States Patent
Chartier et al.

(10) Patent No.: US 6,286,582 B1
(45) Date of Patent: Sep. 11, 2001

(54) PROCESS FOR THE MANUFACTURE OF THIN CERAMIC CORES FOR USE IN PRECISION CASTING

(75) Inventors: Thierry Jean Emile Chartier, Feytiat; Vincent Louis Christian David, Bourges; Mischaël François Louis Derrien, Mouy sur Seine; Eric Jean Eberschveiller, L'Isle Adam; Franck Edmond Maurice Truelle, Argenteuil; Isabelle Marie Monique Valente, Suresnes, all of (FR)

(73) Assignee: Societe Nationale d'Etude et de Construction de Moteurs d'Aviation "SNECMA", Paris (FR)

( * ) Notice: Subject to any disclaimer, the term of this patent is extended or adjusted under 35 U.S.C. 154(b) by 0 days.

(21) Appl. No.: 09/436,770

(22) Filed: Nov. 9, 1999

(30) Foreign Application Priority Data

Nov. 12, 1998 (FR) ..... 98 14168

(51) Int. Cl.[7] ..... B22C 9/10
(52) U.S. Cl. ..... 164/28; 164/228
(58) Field of Search ..... 164/28, 228, 186, 164/369; 249/62; 264/219

(56) References Cited

U.S. PATENT DOCUMENTS 4,093,017 * 6/1978 Miller, Jr. et al. ..... 164/28
4,532,974 * 8/1985 Mills et al. ..... 164/132
4,989,664 * 2/1991 Roth ..... 164/361
5,273,104 * 12/1993 Renaud et al. ..... 164/529
5,498,132 * 3/1996 Carozza et al. ..... 416/97
5,711,833 1/1998 Apte et al. ..... 156/89

FOREIGN PATENT DOCUMENTS 0 328 452 8/1989 (EP) .
0 648 560 4/1995 (EP) .
2 371 257 6/1978 (FR) .
2 241 921 9/1991 (GB) .

* cited by examiner

*Primary Examiner*—Tom Dunn
*Assistant Examiner*—Len Tran
(74) *Attorney, Agent, or Firm*—Oblon, Spivak, McClelland, Maier & Neustadt, P.C.

(57) ABSTRACT

A process for the manufacture of a thin ceramic core involves casting a band of uniform thickness on a support from a solution of a ceramic material based on silica and zircon in a binder, drying the band, shaping the band in a mold and carrying out preheating and pressing of the band in the mold, baking the component thus obtained in a ceramic preform, and then carrying out an impregnation. The thin core obtained can be assembled together with another thin core and/or on a conventional thick central core, and can be used in precision casting such as in the production of turbine blades.

8 Claims, 1 Drawing Sheet

PROCESS FOR THE MANUFACTURE OF THIN CERAMIC CORES FOR USE IN PRECISION CASTING

BACKGROUND OF THE INVENTION

1. Field of the Invention

The present invention relates to a process for the manufacture of thin ceramic cores for use in precision casting, and is particularly applicable to the production of turbine blades.

2. Summary of the Prior Art

The use of casting cores of so-called "ceramic" type is known in particular in applications in which it is necessary to obtain a set of strict quality characteristics and criteria, such as resistance to high temperatures, absence of reactivity, dimensional stability, and good mechanical characteristics. Among the applications which have such requirements are, in particular, aeronautical applications such as, for example, the casting of turbine blades for turbojet engines. The improvements in casting methods, developing from equiaxed casting to casting by directed or monocrystalline solidification, has also increased these requirements in connection with the cores, of which the use and complexity are determined by the search for high performance in the components to be obtained, such as in the case of hollow blades with internal cooling. The processes relevant to these fields of use are precision casting processes, and particularly the process known as lost-wax casting. In all cases, the core is used in the manufacture of hollow components. In the so-called lost-wax casting method, a core of ceramic material is held in position in the mold while metal is poured into the mold, the outer surface of the core forming the inner surface of an internal cavity of the finished product obtained in this way. The accuracy and dimensional stability of the core are therefore essential for conforming to the thicknesses intended for the cast metal components.

Examples of known compositions intended for the preparations of such cores are given in FR-A-2,371,257 and essentially comprise fused silica, powdered zircon, and cristobalite, which is a form of crystallized silica, together with a silicone resin as a binder. Additional elements, such as a lubricant and a catalyst, may be added in small quantities. The preparation method is also described.

In general terms, the cores used for casting the components and blades are composed of ceramic having a generally porous structure: these cores being produced from a mixture consisting of a refractory fraction (in the form of particles) and of a more or less complex organic fraction. Another example is described in EP-A-0,328,452.

In a manner known per se, the shaping of the casting cores, particularly when starting from thermoplastic pastes, can be carried out by molding, for example using press injection. This shaping is followed by a binder removal operation, during which the organic fraction of the core is eliminated by various known means, such as sublimation or thermal degradation, depending on the materials used. This results in a porous structure. A thermal core baking treatment is then applied to the refractory fraction to consolidate the porous structure. This treatment introduces a dimensional change in the form of a contraction, which is often nonisotropic, in the volume of the core, as compared with the initial shape.

At this stage, it may be necessary to reinforce the core so that it is not damaged in the subsequent cycle of use. For this purpose it is known to carry out an impregnation by means of an organic resin.

However, the improvements made to the cooling circuits of turbine blades have given rise to new demands entailing new requirements for the cores used in the manufacture of these blades by casting. In particular, it is difficult using conventional methods of manufacturing ceramic cores by press injection to obtain cores having a thickness of below 0.5 mm over a wide cross section.

SUMMARY OF THE INVENTION

Accordingly, the invention provides a process for the manufacture of a thin ceramic core for use in precision casting, comprising the following steps:

(a) preparing a solution comprising, by mass, 30% of a ceramic material and 70% of a binder material, said ceramic material consisting of, by mass, 70% silica and 30% zircon, and said binder material consisting of, by mass, from 50% to 70% of a solvent, from 15% to 20% of a binding agent, a plasticizer formed by from 5% to 10% of a first product and from 10% to 15% of a second product, and 1% of a dispersing agent;

(b) casting said solution on a support to form a band of said solution having a uniform thickness;

(c) drying said band formed in step (b);

(d) shaping said band in a mold;

(e) preheating said band in said mold to 100° C. for 30 minutes;

(f) pressing said band in said mold under a pressure of 40 MPa for 3 minutes;

(g) baking the component obtained in step (f) in a ceramic preform under the temperature and duration conditions determined for the ceramic material; and, (h) impregnating the core obtained in step (g) by an organic resin or polymer.

Advantageously, one or more thin cores thus obtained may be assembled either with one another or on a thick central core.

The core assembly obtained can then be used in lost-wax casting following the currently known operation of wax injection, clustering, hardening, and casting of the metal component to be obtained, such as turbine blades.

Other preferred characteristics and advantages of the invention will become apparent from the following description of the preferred embodiment and with reference to the accompanying drawings.

DESCRIPTION OF THE PREFERRED EMBODIMENT

In the first step (a) of the process in accordance with the invention, a solution is prepared by mixing in proportions by mass:

30% of a ceramic material composed of, by mass, 70% silica and 30% zircon; and

70% of a binder material composed of, by mass, from 50% to 70% of a solvent which, in this embodiment, consists of an azeotropic mixture of methyl ethyl ketone and ethanol, from 15% to 20% of a binding agent which, in this embodiment, consists of polyvinylbutyral, a plasticizer which, in this embodiment, consists of from 5% to 10% of dibutylphthalate and from 10% to 15% of polyethyleneglycol, and, finally, 1% of a dispersing agent which, in this embodiment, consists of phosphoric ester.

Optionally, and in order to obtain satisfactory deaeration, the solution is set in rotation at a low speed of the order of 1 to 2 revolutions per minute for at least 48 hours.

Figure 1:
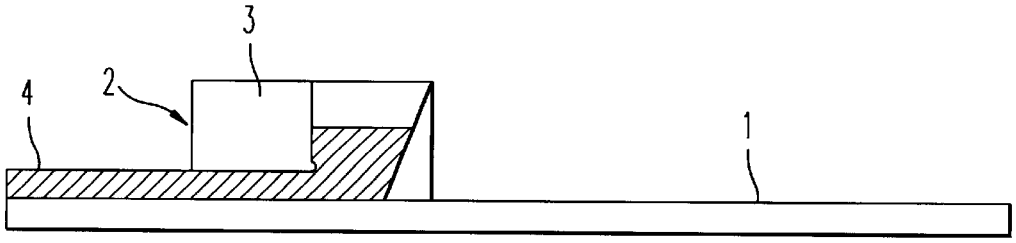
FIG. 1 shows a diagram of the band forming step in a preferred embodiment of the process in accordance with the invention.

The next step (b) of the process is illustrated diagrammatically in FIG. 1, the solution being spread on a support 1 using an applicator shoe 2 equipped with a knife 3 in order to obtain a band 4 of the solution having a uniform thickness.

In the next step (c) the band is dried in order to evaporate the solvent. This leaves a flexible ceramic band having a plasticity which enables it to be placed in a shaping mold in step (d). The shaping mold used is preferably metallic.

In the next step (e), the band is preheated in the mold to 100° C. for 30 minutes, and in the following step (f) the band is pressed by applying a pressure of 40 MPa for 3 minutes while the band remains in the mold.

The component thus obtained is then placed in a ceramic preform in step (g) and undergoes a standard baking cycle which, in the present embodiment, involves maintaining a temperature of 1250° C. for 4 hours.

Figure 2:
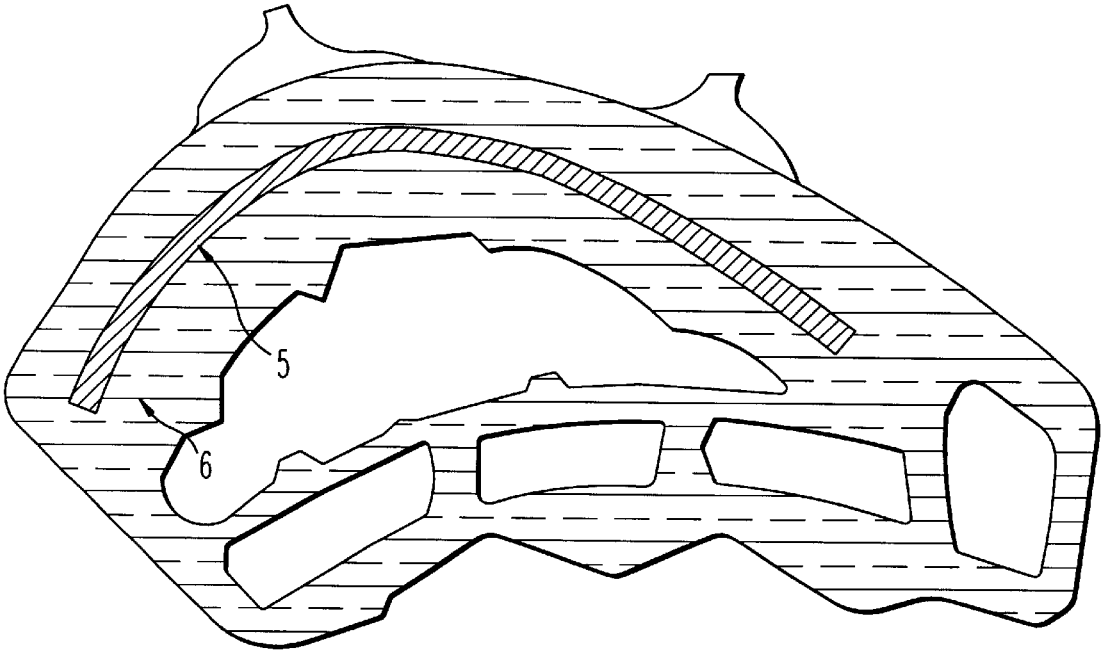
FIG. 2 illustrates an example of a thin core produced in accordance with the invention as used in the casting of a turbine blade.

In the next step (h), the thin core obtained is impregnated with an organic resin or polymer. The core then has sufficient mechanical resistance for it to be used in a casting process, when it will be subjected to pressure forces, particularly during the injection of wax in a lost-wax casting process. FIG. 2 shows a thin core 5 as used in the manufacture of a turbine blade 6.

In order to ensure that the casting has the desired geometries, the thin core obtained by the process of the invention may be assembled together with other thin cores or, alternatively, on a thick central core obtained, for example, by a conventional method of manufacturing casting cores. Various techniques may be used to obtain the assembly. In particular, the cores may be assembled by adhesive bonding, for example using a ceramic adhesive based on colloidal silica and a mineral filler of the mullite type in proportions, by mass, of 30 to 70 for example. A mechanical connection using a mortise-and-tenon joint may also be used to effect the assembly. Alternatively the connection can be made by passing a quartz tube through the cores and fixing the tube in the cavity by means of ceramic adhesive.

The multicore obtained after assembly can then be used as a standard casting core and be subjected to the normal operations of a casting cycle: injection of wax, clustering, hardening, casting of the component to be obtained, cooling, and elimination of the core.

One of the advantages of using thin cores produced in accordance with the invention is that it facilitates the fine tuning of the cooling cavities in the components to be cast, such as turbine blades. In fact, the modifications are made easier because the cores obtained are machineable.

Since thicknesses as low as, for example, 0.3 mm can be achieved, it is possible to concentrate the circulation of the cooling fluid in the cast component as near as possible to the walls to be cooled.

The use of thin ceramic cores produced in accordance with the invention also affords various advantages in terms of its use. In particular it is possible:

to create turbulence promoters in the form of ridges or ribs, after the core has been produced;

to develop thermal bridges and partitions;

to obtain cooling capable of being modulated zonally;

to position the emission of cold air at a specific location on the profile of a blade for example;

to cool the blade tip in the case of a movable blade, the air impinging directly from the root toward the blade tip; and to provide an outlet direct from the thin core in the blade tip or in the trailing edge of the blade for discharge of cooling air.

Furthermore, the use of the process in accordance with the invention has given good results in production, where low rejection rates have been achieved.

What is claimed is:

1. A process for the manufacture of a thin ceramic core for use in precision casting, comprising the following steps:

(a) preparing a solution comprising, by mass, 30% of a ceramic material and 70% of a binder material, said ceramic material consisting of, by mass, 70% silica and 30% zircon, and said binder material consisting of, by mass, from 50% to 70% of a solvent, from 15% to 20% of a binding agent, a plasticizer formed by from 5% to 10% of a first product and from 10% to 15% of a second product, and 1% of a dispersing agent;

(b) casting said solution on a support to form a band of said solution having a uniform thickness;

(c) drying said band formed in step (b);

(d) shaping said band in a mold;

(e) preheating said band in said mold to 100° C. for 30 minutes;

(f) pressing said band in said mold under a pressure of 40 MPa for 3 minutes;

(g) baking the component obtained in step (f) in a ceramic preform under the temperature and duration conditions determined for the ceramic material; and, (h) impregnating the core obtained in step (g) by an organic resin or polymer.

2. The process as claimed in claim 1, wherein, between steps (a) and (b), said solution obtained in step (a) is subjected to a deaeration step comprising rotating said solution at a low speed of 1 to 2 revolutions per minute for at least 48 hours.

3. The process as claimed in claim 1, wherein said baking in step (g) is carried out at 1250° C. for 4 hours.

4. The process as claimed in claim 1, wherein the thin ceramic core obtained is assembled with at least one other thin ceramic core and/or on a thick central core obtained by a conventional core manufacturing method.

5. The process as claimed in claim 4, wherein the said cores are assembled by adhesive bonding.

6. The process as claimed in claim 5, wherein said adhesive bonding is carried out by means of a ceramic adhesive based on colloidal silica and a mullite based mineral filler in proportions, by mass, of 30 to 70.

7. The process as claimed in claim 4, wherein said cores are assembled by means of a mechanical connection of the mortise-and-tenon type.

8. The process as claimed in claim 4, wherein said cores are assembled by means of a quartz tube passing through the cores and retained by means of ceramic adhesive.

* * * * *